US008677798B2

(12) United States Patent
Chazal et al.

(10) Patent No.: US 8,677,798 B2
(45) Date of Patent: Mar. 25, 2014

(54) DEVICE FOR TURNING OVER A FLATTENING ELEMENT AND FLATTENING ELEMENT ENGAGING WITH SAID DEVICE

(75) Inventors: Jean-Pierre Chazal, Trelins (FR); Bernard Dumas, Montbrison (FR); Vincent Philippaux, Montbrison (FR)

(73) Assignee: Siemens VAi Metals Technologies SAS, Saint-Chamond (FR)

( * ) Notice: Subject to any disclaimer, the term of this patent is extended or adjusted under 35 U.S.C. 154(b) by 300 days.

(21) Appl. No.: 13/257,643

(22) PCT Filed: Apr. 22, 2009

(86) PCT No.: PCT/EP2009/054764

§ 371 (c)(1),
(2), (4) Date: Nov. 8, 2011

(87) PCT Pub. No.: WO2010/105697

PCT Pub. Date: Sep. 23, 2010

(65) Prior Publication Data

US 2012/0096917 A1 Apr. 26, 2012

(30) Foreign Application Priority Data

Mar. 20, 2009 (EP) ..... 09 290 208

(51) Int. Cl.

| | |
|---|---|
| ***B21D 43/10*** | (2006.01) |
| ***B21D 43/11*** | (2006.01) |
| ***B21B 41/06*** | (2006.01) |

(52) U.S. Cl.

USPC ..... 72/420; 72/422; 72/202; 72/229; 29/527.7; 29/33 C; 414/392; 414/590; 414/775; 148/202

(58) Field of Classification Search

USPC ..... 29/527.7, 33 C; 72/202, 229, 420, 422; 414/392, 590, 775, 779; 148/202

See application file for complete search history.

(56) References Cited

U.S. PATENT DOCUMENTS

| | | | | |
|---|---|---|---|---|
| 2,915,199 | A * | 12/1959 | Evans | 414/759 |
| 3,189,192 | A * | 6/1965 | Egger | 414/775 |
| 3,870,570 | A * | 3/1975 | Fieser et al. | 148/202 |

(Continued)

FOREIGN PATENT DOCUMENTS

| | | |
|---|---|---|
| CN | 101336143 A | 12/2008 |
| DE | 2131739 | 5/1972 |

(Continued)

*Primary Examiner* — David B Jones

(74) *Attorney, Agent, or Firm* — Laurence A. Greenberg; Werner H. Stemer; Ralph E. Locher

(57) ABSTRACT

A device for turning over a flattening element having a plurality of spaced-apart cylinders rotatably mounted on a frame and a device for securing it to the turning-over device, includes two uprights extending vertically from a base. A supporting and securing device for the flattening element engages with the securing device of the flattening element. The supporting and securing device is disposed between the uprights. A device rotates the supporting and securing device about a horizontal axis between a first position in which, when the flattening element is connected to the turning-over device, the cylinders of the flattening element are oriented downward, and a second position in which, when the flattening element is connected to the turning-over device, the cylinders of the flattening element are oriented upward. Vertical translation drive devices vertically translate the supporting and securing device. Each vertical translation drive device is connected to one respective upright.

17 Claims, 7 Drawing Sheets

(56) References Cited

U.S. PATENT DOCUMENTS

| | | | | | |
|---|---|---|---|---|---|
| 4,557,135 | A | * | 12/1985 | Ragettli et al. | 72/420 |
| 4,712,292 | A | | 12/1987 | King | |
| 4,974,435 | A | | 12/1990 | Vandenbroucke | |
| 5,169,275 | A | * | 12/1992 | Kratz | 414/392 |
| 5,533,248 | A | * | 7/1996 | Tippins et al. | 29/527.7 |
| 5,664,452 | A | * | 9/1997 | Engel et al. | 72/229 |
| 5,680,785 | A | | 10/1997 | Quehen et al. | |
| 5,826,818 | A | * | 10/1998 | Douaud | 72/231 |
| 2009/0165522 | A1 | | 7/2009 | Rossigneux | |

FOREIGN PATENT DOCUMENTS

| | | | |
|---|---|---|---|
| EP | 0198036 | A1 | 10/1986 |
| EP | 1918036 | A1 | 5/2008 |
| JP | 57062818 | A | 4/1982 |
| JP | 60033824 | A | 2/1985 |
| JP | 619925 | A | 1/1986 |
| RU | 2040688 | C1 | 7/1995 |
| RU | 2065831 | C1 | 8/1996 |
| WO | 2008/099126 | A2 | 8/2008 |
| WO | 2008/145355 | A1 | 12/2008 |

* cited by examiner

DEVICE FOR TURNING OVER A FLATTENING ELEMENT AND FLATTENING ELEMENT ENGAGING WITH SAID DEVICE

BACKGROUND OF THE INVENTION

Field of the Invention

The invention relates to the field of flattening thick metal strips or plates. It relates in particular to a device for turning over a flattening element and a flattening element engaging with the device.

Thick strips are flattened by a succession of alternating flexions of decreasing amplitude without any application of external traction upstream or downstream of the flattening machine. These flattening machines comprise two flattening elements each carrying a series of cylinders with parallel axes placed respectively above and below the strip, the cylinders being offset longitudinally and vertically so as to be nested, thus determining an undulating path for the strip, which is thereby subjected to the effects of successive alternating flexions. These alternating flexions are reflected in curves generating deformations in the strip which vary from a state of traction on the upper surface of the curve to a state of compression on the lower surface, passing through a zero value in the median axis or "neutral fiber" of the strip according to a law of linear variation. Depending on the amplitude of the curve, the stresses thus generated may exceed the elastic limit of the strip over a greater or lesser fraction of its thickness. This plasticization is a decisive element in the elimination of evenness defects which cannot be drawn out, such as "long edges", "long centers", etc. The plasticized fraction of the thickness of a strip is usually expressed as a percentage of the total thickness designated by the term "plasticization rate".

Generally speaking, each flattening element, respectively lower or upper, comprises a plurality of cylinders with parallel axes which normally have a reduced diameter and are therefore held by at least two supporting cylinders, which may themselves rest on rows of wheels, the set of these cylinders and wheels being assembled on a frame.

These two flattening elements, placed respectively below and above a horizontal plane of travel of the strip, are placed in a supporting frame comprising four columns arranged on each side of the longitudinal axis of travel of the strip and firmly held in their lower part by a fixed base and in their upper part by transverse beams, the assembly forming a closed frame.

The lower flattening element rests on the fixed base and the upper element rests on a pressure frame which can be moved vertically between the four columns by means of mechanical or hydraulic jacks resting on the upper part of the frame so as to adjust the separation of the two flattening elements and, consequently, the nesting of the cylinders, while taking up the separating forces due to the resistance of the product.

Usually, at least some of the flattening cylinders are rotated about their axes in order to advance the strip by friction at a determined speed following an undulating path between the lower and upper cylinders.

During the flattening operation, the cylinders are subjected to high surface pressure stresses and abrasion phenomena, which require reconditioning, for example machining by grinding their active surfaces, in a maintenance workshop. In this context, the upper and lower flattening elements must be removed from the flattening machine. The lower flattening element with its flattening cylinders directed upward will easily be able to be ground. However, the upper flattening element with its flattening cylinders directed downward must first of all be turned over so that the operators can gain access to its flattening cylinders.

Publication WO2008/099126 discloses a turning-over device for an upper flattening element of a flattening machine. The flattening element is first extracted from the flattening machine and held by a lifting beam. The lifting beam is then placed on a cradle. During all these stages, the cylinders of the upper flattening element are not accessible to the operators and the actual repair operations cannot begin. The lifting beam is rotatably mounted on a cradle about pivots and is able to pivot about a horizontal axis so as to rotate the upper flattening element. It is only at the end of this last stage that the flattening cylinders of the upper flattening element become accessible.

These turning-over operations require the execution of numerous operations implemented by operators in a potentially dangerous environment. The operators must in particular maneuver the lifting beam and the supporting cradle for the flattening cylinders, which may be at high temperatures. Also, a large number of successive manipulations and operations have to be undertaken.

There is therefore a need for a simple means of turning over, necessitating the least possible operator intervention and performing the fastest possible turning over with the fewest stages possible.

BRIEF SUMMARY OF THE INVENTION

For this purpose, the object of the invention is a turning-over device for a flattening element, the flattening element comprising a plurality of cylinders spaced apart from each other and rotatably mounted on a frame and means for securing it to the turning-over device, the turning-over device being characterized in that it comprises:

- two uprights extending vertically from a base,
- supporting and securing means for the flattening element engaging with the securing means of the flattening element, the supporting and securing means being arranged between the uprights,
- means for rotating the supporting and securing means about a horizontal axis between a first position in which, when the flattening element is connected to the turning-over device, the cylinders of the flattening element are oriented downward, and a second position in which, when the flattening element is connected to the turning-over device, the cylinders of the flattening element are oriented upward,
- driving means for vertically translating the supporting and securing means, each translation means being connected to one of the uprights.

According to other characteristics of the turning-over device:

- each supporting upright comprises two arms arranged opposite each other and extending vertically from the base, each arm carrying on its internal face at least one guide rail for the vertical translation means for the supporting and securing means of each flattening element,
- the supporting and securing means comprise a frame comprising two horizontal crosspieces extending longitudinally and in parallel between the uprights, the crosspieces being connected together by two transverse bars,
- the frame comprises two holding pieces placed opposite each other and accepting one of the ends of each crosspiece, these holding pieces also being integrated with the translation means for the supporting and securing means.

each holding piece extends partly at least below the crosspieces, each holding piece comprises a U-shaped portion, each U-shaped portion forming a support and accepting one of the ends of each crosspiece, the supporting and securing means comprise a plurality of hooks each extending from a holding piece beneath a crosspiece, the free end of each hook being directed upward when the turning-over device is in its resting position, the distance between the free end of each hook and the lower face of the horizontal crosspiece closest to it is such that it allows the passage of the securing means belonging to the flattening element and clamping of this flattening element, each hook comprises at its free end a cylindrical portion intended to support and guide the securing means for the flattening element when it is introduced into the turning-over device, the hooks are located at the top of an imaginary rectangle of predetermined width, the supporting and securing means comprise means for stopping the translation of the flattening element and for holding the flattening element during rotation of the supporting and securing means, the holding means comprise two L-shaped clamping bars forming a stop for the flattening element, in particular during rotation of the supporting and securing means, each clamping bar is integrated with a transverse bar and extends downward from this transverse bar when the turning-over device is in its first position, the translation means for the frame comprise at least two drive spindles each extending vertically from the base of each of the uprights and between the two arms of each upright, the translation means comprise:

two guide rods each accepting two of the drive spindles to guide them in vertical translation, each guide rod being suitable for ascending or descending along the spindles it accepts, two translation devices for the guide rods engaging with the drive spindles, each guide rod carries the rotary drive means for the supporting and securing means, the rotary drive means for the supporting and securing means comprise a geared motor or a jack.

The object of the invention is also a flattening element suitable for engaging with the turning-over device as defined above, the flattening element comprising a plurality of cylinders spaced apart from each other and rotatably mounted on a frame characterized in that it comprises means for securing same to the turning-over device.

According to other characteristics of the flattening element:

the securing means for the flattening element comprise a plurality of hooks integrated with the frame and intended to engage with the securing means for the turning-over device, the free end of each hook being directed downward prior to the introduction of the flattening element into the turning-over device, each hook of the flattening element is positioned so as to rest on one of the hooks of the turning-over device when the flattening element is completely inserted into the turning-over device, the hooks of the flattening element are grouped in pairs, each pair of hooks being at the top of an imaginary rectangle of predetermined width.

the width of the imaginary rectangle defining the position of the hooks of the flattening element is less than or equal to the width of the imaginary rectangle defining the position of the hooks of the turning-over device.

BRIEF DESCRIPTION OF THE SEVERAL VIEWS OF THE DRAWING

Other characteristics and advantages of the present invention will become apparent upon reading a detailed, non-restrictive embodiment, with reference to the figures where.

DESCRIPTION OF THE INVENTION

Figure 1:
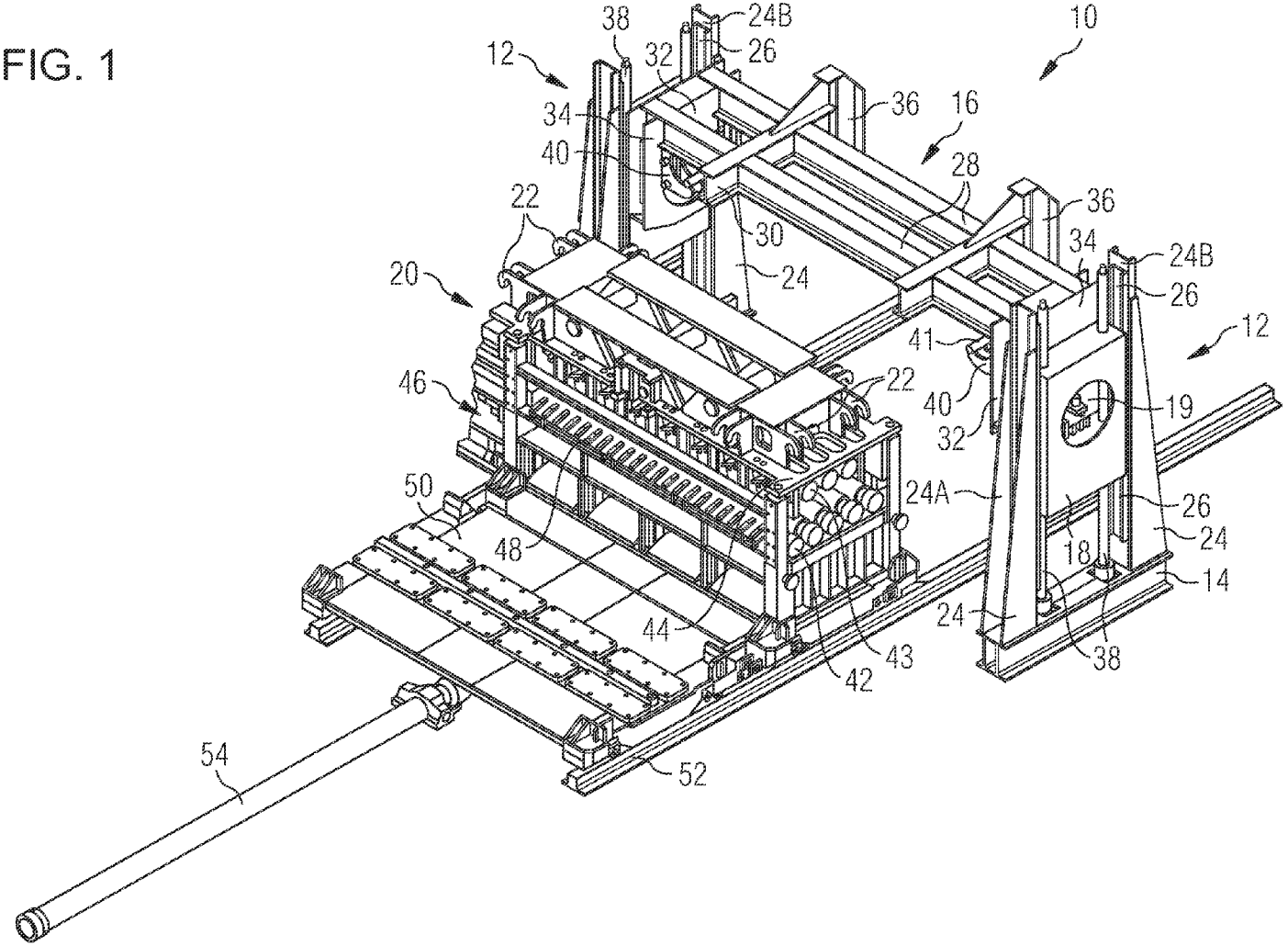
FIG. 1 is a perspective view of a turning-over device according to the invention and a set of flattening elements located outside the turning-over device.
Figure 2:
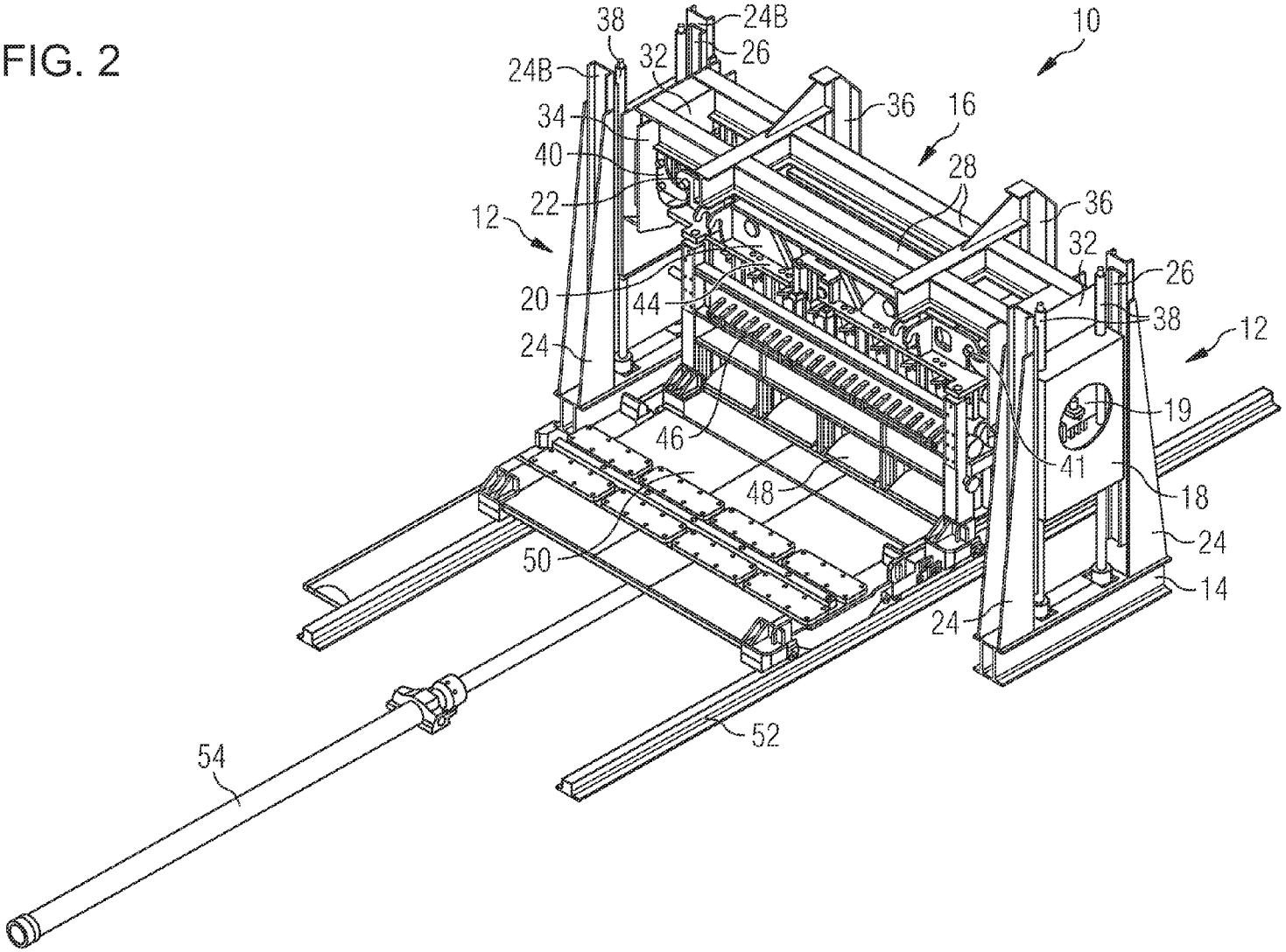
FIGS. 2, 3 and 5 to 7 are successive views of the stages of turning over one of the flattening elements by the device according to the invention, starting from the position in FIG. 1.
Figure 3:
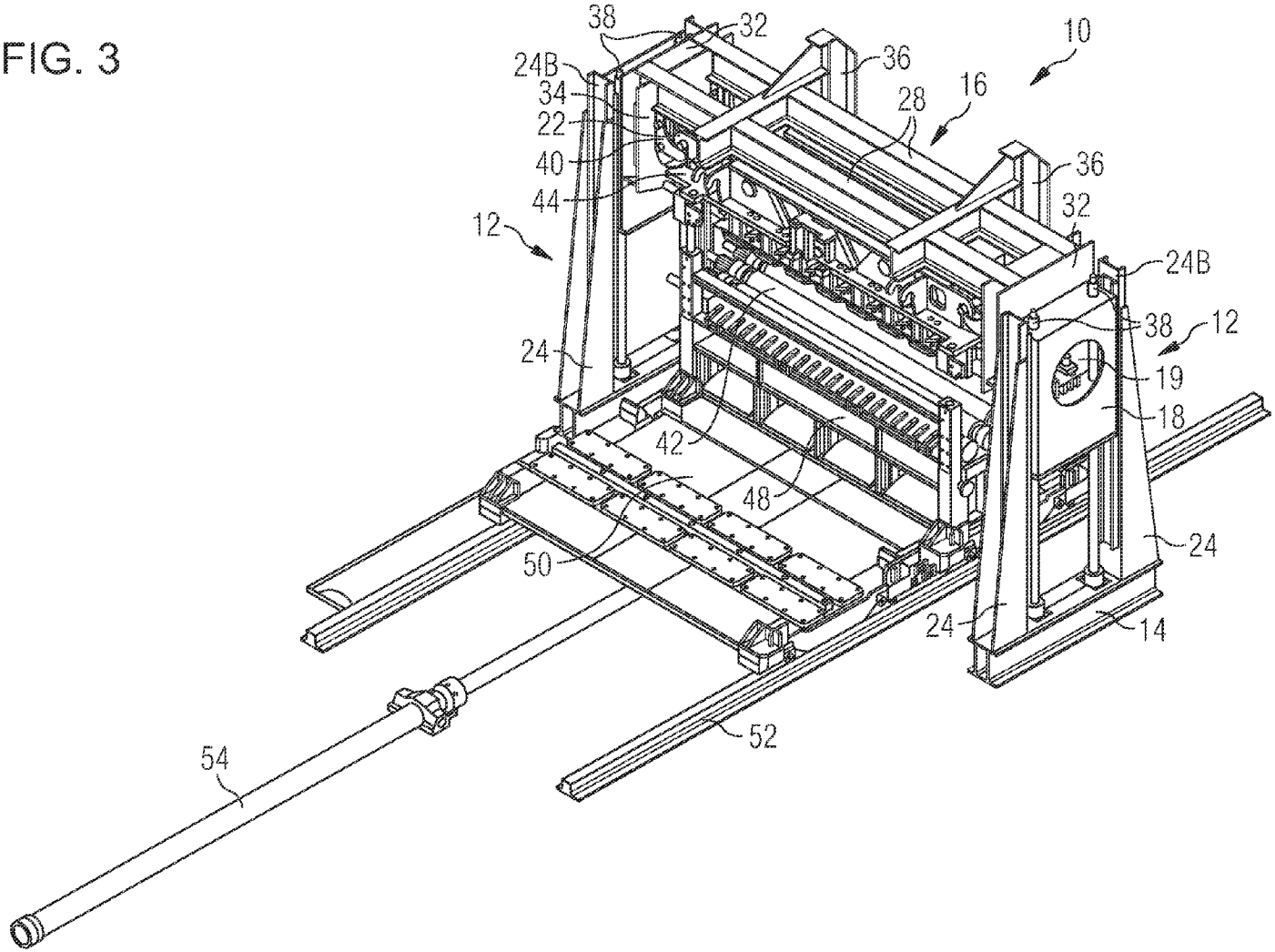

FIG. 1 is a perspective view of a turning-over device 10 according to the invention and an assembly comprising an upper flattening element 20 placed on a lower flattening element 46. The flattening elements 20 and 46 each comprise a frame marked respectively 44 and 48. Each frame 44, 46 accepts a plurality of flattening cylinders mounted rotatably and marked respectively 43 and 42 in FIG. 1. As represented in FIG. 1, the assembly formed by the flattening elements 20 and 46 has first been removed from a flattening machine (not represented in the figures) for the flattening cylinders to be changed or ground. When the upper flattening element 20 is integrated with the lower flattening element 46, the operators do not have access to the flattening cylinders 42 and 43 and any operation to change or grind the flattening elements 42 and 43 is therefore impossible. It must therefore be possible to detach the upper flattening element 20 from the lower flattening element 46.

For this purpose, the upper flattening element 20 comprises means for securing it to the turning-over device 10. More precisely, the securing means of the flattening element 20 comprise a plurality of hooks 22 integrated with the frame 44 and intended to engage with the securing means 40 of the turning-over device. As can be seen in FIG. 1, the free end of each hook 22 is directed downward prior to the introduction of the flattening element 20 into the turning-over device 10.

Each hook 22 of the flattening element is positioned so as to rest on one of the hooks 40 of the turning-over device 10 when the flattening element is completely inserted into the turning-over device 10, as will be explained later. The hooks 22 define a passage for the hooks 40 of the turning-over device, these latter also acting as guides for the upper flattening element during its introduction into the turning-over device 10. The hooks 22 are grouped in pairs, each pair of hooks 22 being approximately at the top of an imaginary rectangle of predetermined length and width. The hooks 22 of a single pair extend parallel to each other from a vertical face of the frame 44 of the upper flattening element 20.

The assembly formed by the two flattening elements is placed on a transfer platform 50, itself placed on transport rails 52. This platform 50 is connected to a transfer jack 54 capable of pushing the platform 50 from a position in which the assembly formed by the two flattening elements 20 and 46 is located outside the turning-over device to a position in which the upper flattening element 20 is held by the turning-over device 10, as will be explained later.

Figure 4:
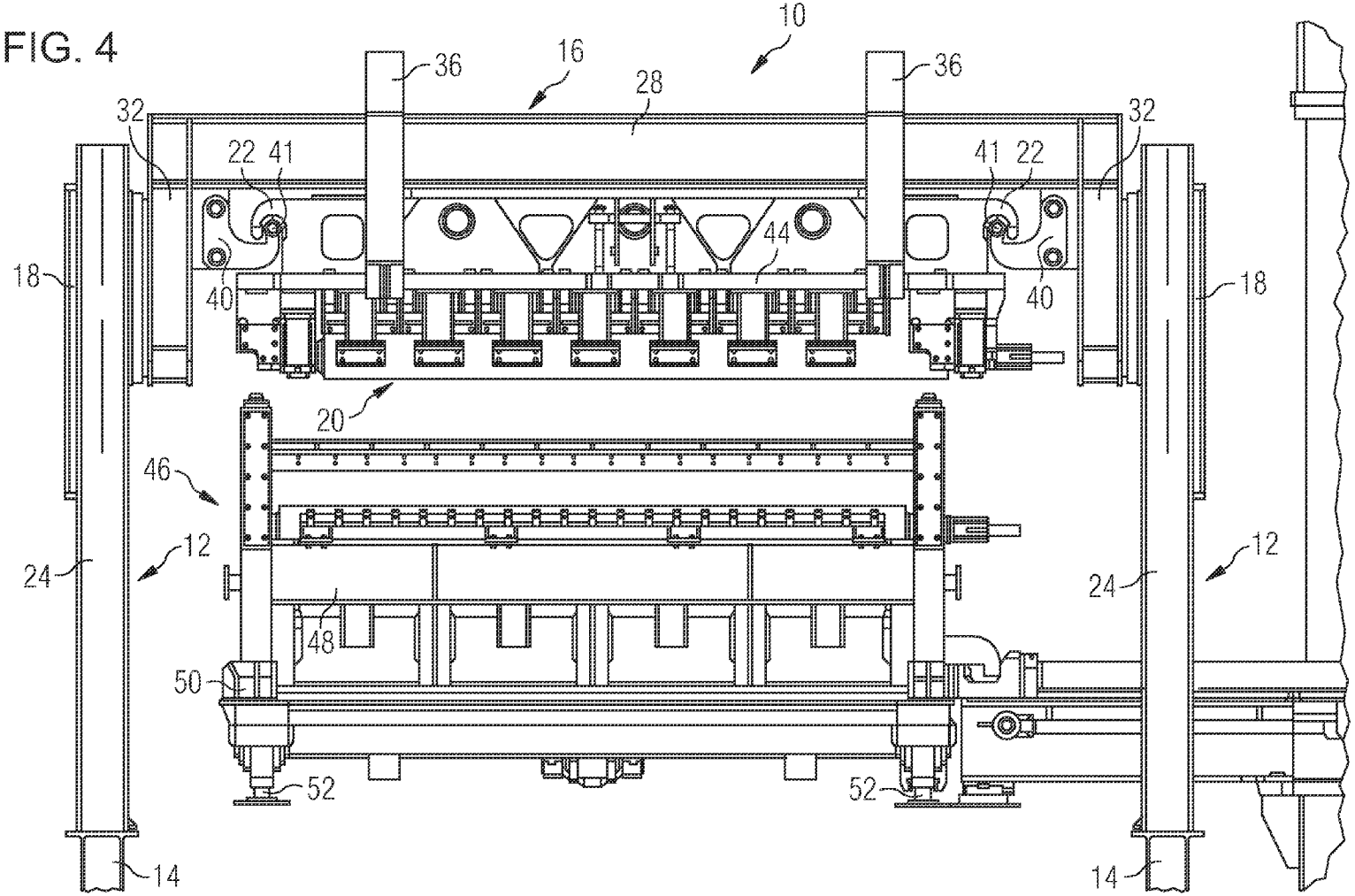
FIG. 4 is a rear view of the turning-over device in FIG. 1 carrying one of the flattening elements in a high position.
Figure 5:
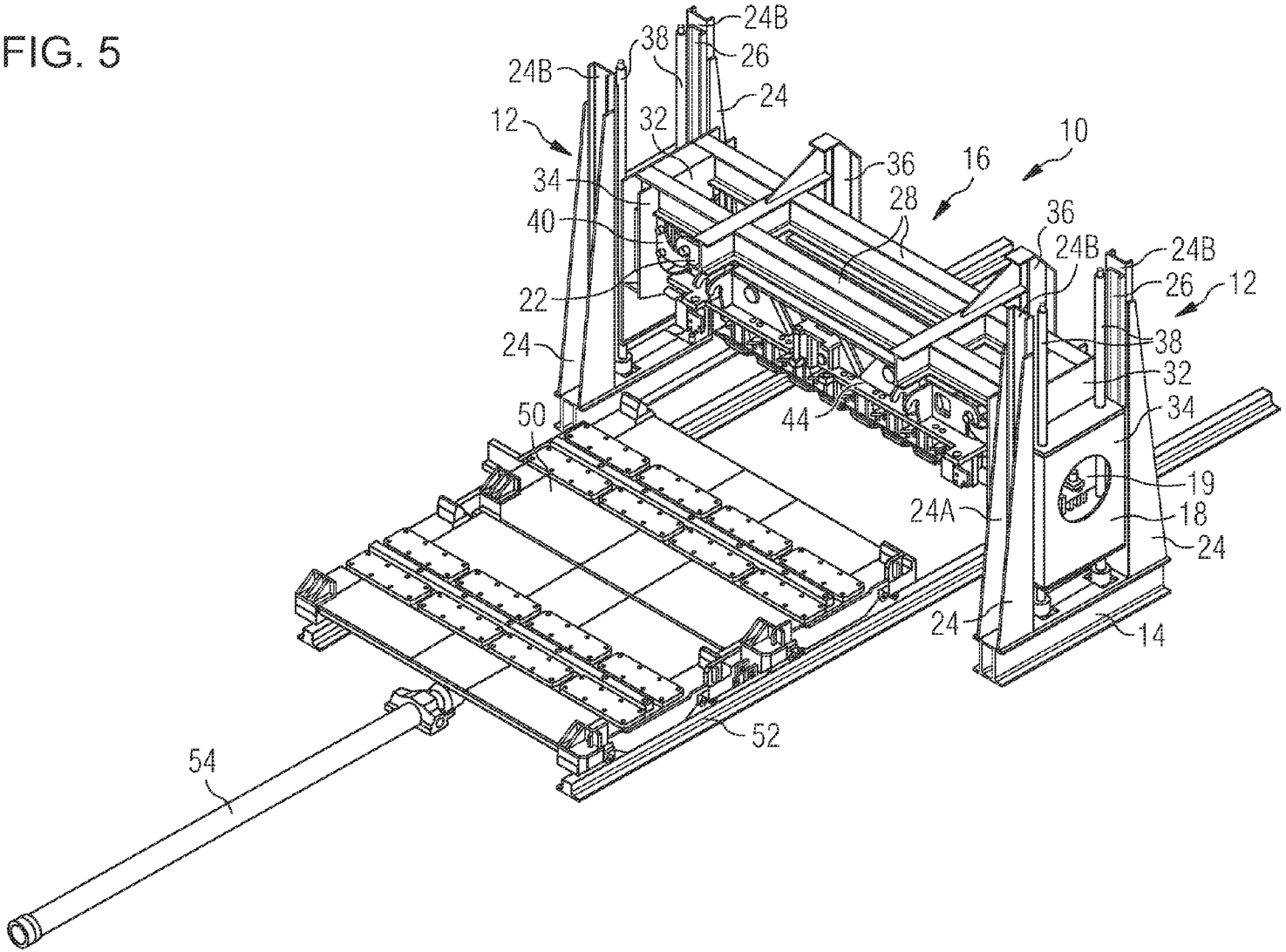

As can be seen in FIGS. 1 and 4, the turning-over device according to the invention comprises two uprights 12 extending vertically from a base 14 of the supporting and securing means 16 of the upper flattening element 20 intended to engage with the securing means 22 of the flattening element 20, the supporting and securing means 16 being arranged between the uprights 12. The turning-over device also comprises rotary drive means 19 to rotate the supporting and securing means 16 about a horizontal axis between a first position in which, when the flattening element 20 is connected to the turning-over device, the cylinders 42 of the flattening element 20 are directed downward, and a second position in which the cylinders 42 of the flattening element 20 are directed upward, as will be explained later. The turning-over device 10 also comprises means 18 for vertically translating the supporting and securing means 16. Each drive means 18 is connected to one of the uprights 14.

The uprights 14 are installed opposite each other and are separated by a distance allowing for the insertion of an assembly of flattening elements 20, 46. Each supporting upright 14 comprises two arms 24 arranged opposite each other and extending vertically from the base 14. Each arm 24 comprises triangular fins 24A extending vertically from the base 14 and integrated with a straight vertical portion 24B. Each arm 24 also comprises, on the internal face of each straight portion 24B, at least one guide rail 26 for the vertical translation means 18 of the supporting and securing means 16.

According to the invention, the vertical translation means 18 of the supporting and securing means 16 and thus of the upper flattening element 20 comprise translation drive spindles 38 each extending vertically and parallel between the two arms 24 of each upright 12. Preferably, two cylindrical translation drive spindles 38 are installed per upright. The translation drive means also comprise two guide rods 18 each accepting two of the translation drive spindles 38 to drive then in vertical translation, each guide rod 18 being suitable for ascending or descending along the drive spindles 38 it accepts under the action of a drive device which may be internal to each guide rod 18. The translation drive spindles 38 may form part of screw jacks. Each guide rod is positioned between the arms 24 of an upright 12 and is guided in translation by two rails 26. The vertical translation means 18 may comprise other types of drive device, such as other types of jacks, screw/nut or pinion/rack systems or even chains.

The turning-over device 10 of the upper flattening element 20 comprises supporting and securing means comprising a frame 16. The frame 16 comprises two horizontal crosspieces 28 extending longitudinally and parallel between the uprights 12. The crosspieces are connected together by two transverse bars 30. The crosspieces 28 and the transverse bars 30 extend in a plane perpendicular to the planes containing the uprights 12. The length of each transverse bar is greater than the length of the assembly formed by the upper 20 and lower 46 flattening elements.

The frame 16 also comprises two holding pieces 32 placed opposite each other which each accept one of the ends of each crosspiece 28 and these holding pieces 32 are also integrated with the translation drive means 18 of the supporting and securing means 16. More precisely, in the embodiment represented in FIGS. 1 to 7, each holding piece 32 is integrated with a guide rod 18 and is driven in vertical translation by this guide rod 18. Each holding piece 32 extends at least partially below the crosspieces 28 and comprises a U-shaped portion forming a support for the crosspieces 28 and accepting one of the ends of each crosspiece 28.

The supporting and securing means 16 comprise a plurality of hooks 40 each extending from one of the holding pieces 32 below a crosspiece 28, the free end 41 of each hook 40 being directed upward when the turning-over device 10 is in its first position. Each hook 40 is positioned so that the distance between its free end 41 and the lower face of the horizontal crosspiece 28 closest to it allows the passage of the securing means 22 belonging to the flattening element 20 and clamping of this flattening element 20.

Also, each hook 40 comprises at its free end a cylindrical portion 41 intended to support and guide the securing means 22 of the flattening element 20 when it is introduced into the turning-over device 10. In the embodiment in FIGS. 1 to 7, the hooks 40 are four in number and are located at the top of an imaginary rectangle of predetermined length and width.

The supporting and securing means 16 comprise retaining means for stopping the translation of the flattening element 20 and for holding the flattening element 20 during rotation of the supporting and securing means 16. The retaining means comprise two L-shaped clamping bars 36 forming a stop for the flattening element 20 during rotation of the supporting and securing means 16. Each clamping bar 36 is integrated with a transverse bar 30 and extends downward from this transverse bar 30 when the turning-over device 10 is in its first position.

According to the invention, the turning-over device also comprises rotary drive means 19 for the supporting and securing means. These rotary drive means 19 are, in the embodiment in FIGS. 1 to 7, carried by at least one of the guide rods 18. Advantageously, each guide rod 18 is able to carry a rotary drive means 19 for the supporting and securing means 16. More precisely, each guide rod 18 is able to carry drive means 19 for horizontal rotation of the frame 16 which engages with a pivot (not represented in the figure) of one of the holding pieces 32, the actuation of this drive unit causing the holding piece 32 to rotate and thus also the frame 16. The drive means 19 may take the form of a geared motor or a jack (not represented).

In order to allow for interlocking of each hook 22 of the upper flattening element 20 with a corresponding hook of the turning-over device 10, the width of the imaginary rectangle defining the position of the hooks 22 of the flattening element 20 may be less than or equal to the width of the imaginary rectangle defining the position of the hooks 40 of the turning-over device 10.

A description will now be given of the different stages of turning over a flattening element 20 with reference to FIGS. 1 to 7, the initial position being that represented in FIG. 1.

During a first stage, the vertical translation drive means of the guide rods 18 are actuated to drive the guide rods 18 and thus the frame 16 until the hooks 40 of the frame 16 are positioned opposite the hooks 22 of the upper flattening element 20 closest to the turning-over device 10. The jack 54 then pushes the platform 50, which gives rise to the translation of the assembly comprising the upper 20 and lower 46 flattening elements. During this translation, the first two pairs of hooks 22 of the upper flattening element 20 closest to the turning-over device 10 each engage on the cylindrical portion 41 of one of the first hooks 40 belonging to the frame 16. Each cylindrical portion 41 of a first hook 40 belonging to the frame 16 thus acts as a translation guide for the assembly formed by the two upper 20 and lower 46 flattening elements. Translation proceeds and the first pairs of hooks 22 of the upper flattening element 20 advance and go past the first hooks 40 belonging to the frame 16. Each first pair of hooks 22 of the upper flattening element 20 then engages on the cylindrical portion 41 of one of the second hooks 40 belonging to the frame 16, the second hooks 40 (visible in FIG. 4) being located at the rear of the turning-over device 10 in the direction of advance of the platform 50. Simultaneously, each second pair of hooks 22 of the upper flattening element 20 engages on the cylindrical portion 41 of one of the first hooks 40 belonging to the frame 16. Translation proceeds until the assembly formed by the two upper 20 and lower 46 flattening elements comes to a stop against the two L-shaped clamping bars 36. In this position, each of the hooks 22 of the upper flattening element 20 is engaged with a hook 40 of the turning-over device 10 and the imaginary rectangles defining respectively the position of the hooks 22 of the upper flattening element 20 and the position of the complementary hooks 40 of the turning-over device 10 are superimposed or merged. It is therefore possible that the imaginary rectangles defining respectively the position of the hooks 22 of the upper flattening element 20 and the position of the complementary hooks 40 of the turning-over device 10 have the same dimensions. We are then in the position represented in FIG. 2.

The vertical translation drive means for the guide rods 18 are then actuated to drive the guide rods 18 and thus the frame 16 upward. The upper flattening element 20 engaged with the frame 26 is also driven upward and is detached from the lower flattening element 46. We are then in the position represented in FIGS. 3 and 4. In this position, the hooks 22 of the flattening element 20 are engaged with the hooks 40 of the turning-over device 10 which support all of the weight of the upper flattening element 20, this weight possibly being several tens of tonnes.

The transfer jack 54 then pulls the platform 50 toward another zone of the flattening installation for the lower flattening element 46 to be ground.

In the following stage, the vertical translation drive means 38 for the guide rods 18 are actuated to drive the guide rods 18 and thus the frame 16 in vertical translation downward. We are then in the position represented in FIG. 5.

Figure 6:
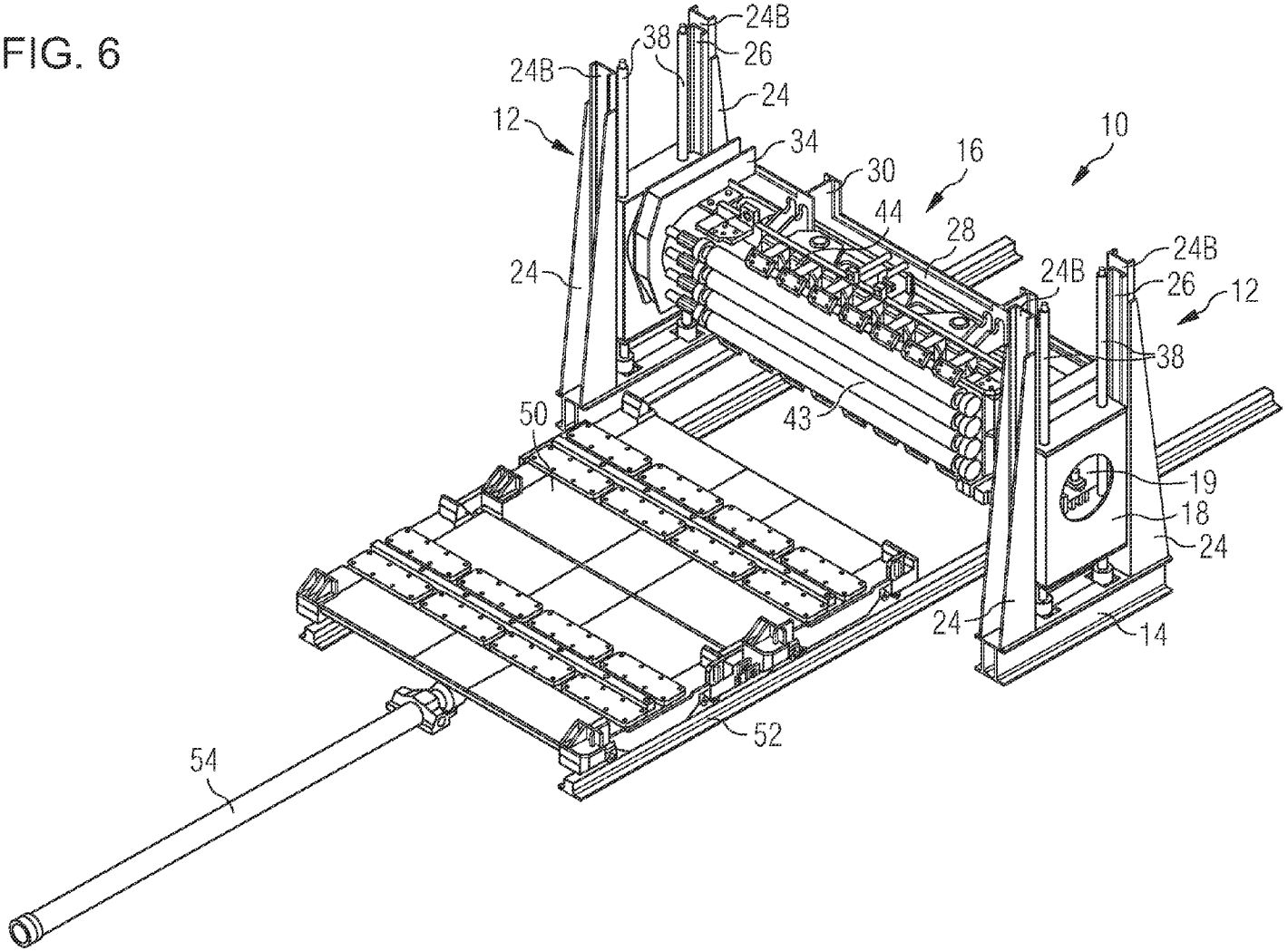
Figure 7:
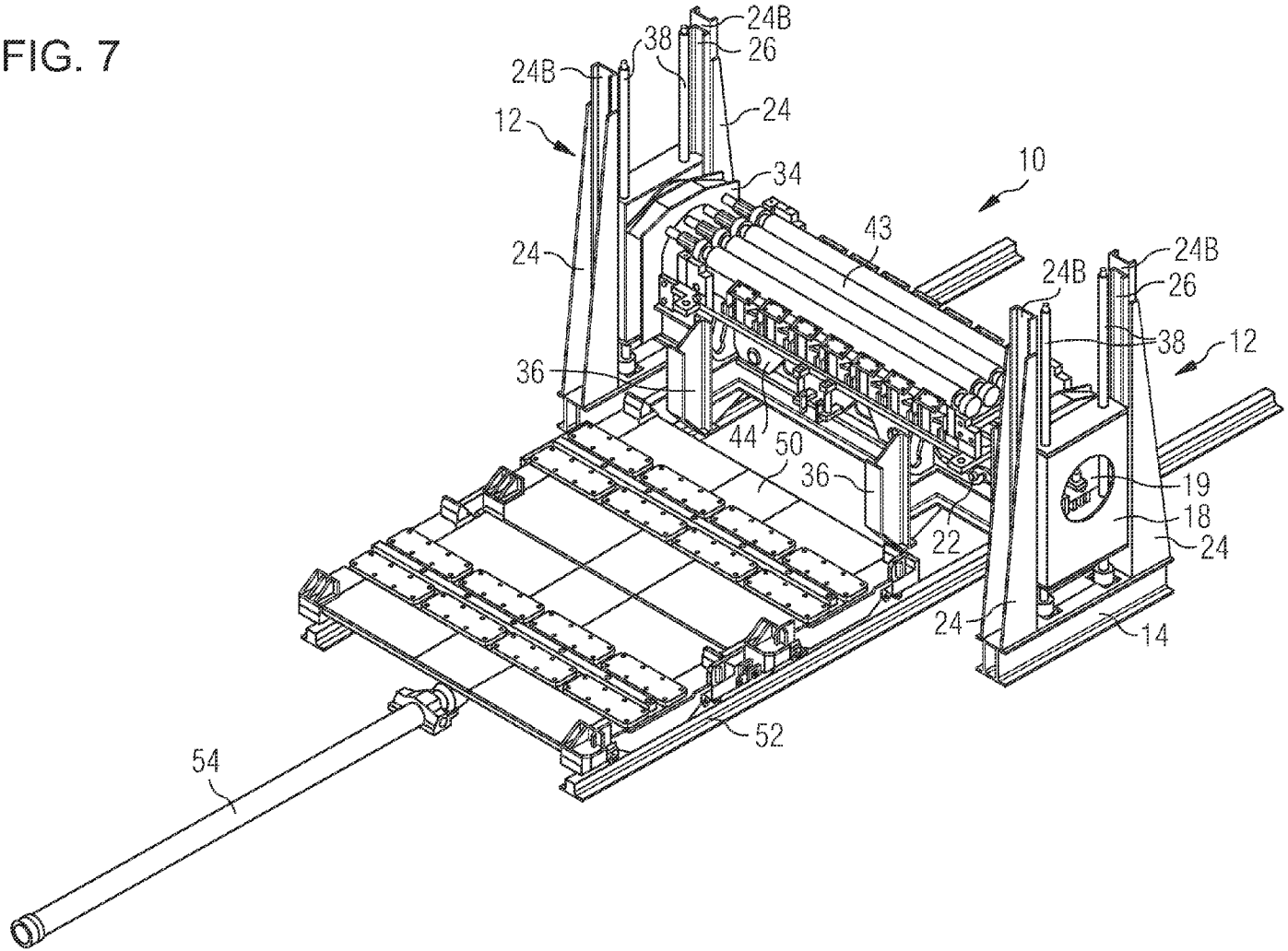

Next, the drive means 19 for rotating the frame about a horizontal axis are actuated. The upper flattening element 20 pivots through 180 degrees in the clockwise direction from a first position in which the cylinders 43 of the upper flattening element 20 are directed downward to a second position in which the cylinders 43 of the flattening element 20 are oriented upward. An intermediate position of the flattening element pivoted through 90 degrees is represented in FIG. 6.

In the following stage, the vertical translation drive means for the guide rods 18 are actuated to drive the guide rods 18 and thus the frame in vertical translation downward to a low position allowing an operator to gain access to the flattening cylinders of the upper flattening element 20 or allowing it to be gripped by a handling tool with a view to removal to another zone of the installation.

The invention claimed is:

1. A turning-over device for a flattening element, the flattening element having a frame, a plurality of mutually spaced-apart cylinders rotatably mounted on the frame and a device for securing the flattening element to the turning-over device, the turning-over device comprising:

a base;

two uprights extended vertically from said base;

a supporting and securing device for the flattening element, said supporting and securing device disposed between said uprights and engaging the securing device of the flattening element;

a device for rotating said supporting and securing device about a horizontal axis between a first position in which the cylinders of the flattening element are oriented downward when the flattening element is connected to the turning-over device and a second position in which the cylinders of the flattening element are oriented upward when the flattening element is connected to the turning-over device; and vertical translation drive devices for vertically translating said supporting and securing device, each of said vertical translation drive devices being connected to a respective one of said uprights.

2. The device according to claim 1, wherein each of said uprights has two mutually oppositely disposed arms extended vertically from said base, and each of said arms has an internal surface carrying at least one guide rail for one of said vertical translation drive devices for said supporting and securing device for each flattening element.

3. The device according to claim 1, wherein said supporting and securing device includes a frame having two horizontal crosspieces extending longitudinally and in parallel between said uprights and two transverse bars interconnecting said crosspieces.

4. The device according to claim 3, wherein said crosspieces have ends, said frame includes two mutually opposite holding pieces each accepting a respective one of said ends of each of said crosspieces, said holding pieces also being integrated with said vertical translation drive devices for said supporting and securing device.

5. The device according to claim 4, wherein each of said holding pieces extends partly at least below said crosspieces.

6. The device according to claim 4, wherein each of said holding pieces includes a U-shaped portion forming a support and accepting one of said ends of each of said crosspieces.

7. The device according to claim 4, wherein said supporting and securing device includes a plurality of hooks each extending from one of said holding pieces beneath one of said crosspieces, each of said hooks having a free end directed upward when the turning-over device is in said first position.

8. The device according to claim 7, wherein said free ends of each hook are disposed at a distance from a lower surface of said horizontal crosspiece closest to said hook allowing passage of the securing device of the flattening element and clamping of the flattening element.

9. The device according to claim 7, wherein said free ends of each of said hooks include a cylindrical portion configured to support and guide the securing device of the flattening element being introduced into the turning-over device.

10. The device according to claim 7, wherein said hooks are located at the top of an imaginary rectangle of predetermined width.

11. The device according to claim 1, wherein said supporting and securing device includes a device for stopping the translation of the flattening element and for holding the flattening element during rotation of said supporting and securing device.

12. The device according to claim 4, wherein said holding pieces include two L-shaped clamping bars forming a stop for the flattening element.

13. The device according to claim 12, wherein each of said clamping bars is integrated with a respective transverse bar and extends downward from said transverse bar when the turning-over device is in a resting position.

14. The device according to claim 2, wherein said vertical translation drive devices for the frame each include at least two drive spindles extended vertically from said base of a respective one of said uprights and between said two arms of said respective one of said uprights.

15. The device according to claim 14, wherein each of said vertical translation drive devices includes:

two guide rods each accepting two of said drive spindles for guidance in vertical translation, with each guide rod being suitable for ascending or descending along said spindles it accepts, and two translation devices for said guide rods engaging with said drive spindles.

16. The device according to claim 15, wherein said guide rods carry said device for rotating said supporting and securing device.

17. The device according to claim 1, wherein said device for rotating said supporting and securing device includes a geared motor or a jack.

* * * * *